United States Patent [19]

Reese

[11] 4,153,660

[45] May 8, 1979

[54] PROCESS FOR PRODUCING A MIXED-SHRINKAGE HEAT-BULKABLE POLYESTER YARN

[75] Inventor: Cecil E. Reese, Kinston, N.C.

[73] Assignee: E. I. Du Pont de Nemours and Company, Wilmington, Del.

[21] Appl. No.: 847,005

[22] Filed: Oct. 28, 1977

[51] Int. Cl.[2] ..... D01D 5/12

[52] U.S. Cl. ..... 264/103; 28/220; 28/271; 57/250; 57/295; 57/908; 264/136; 264/210 F

[58] Field of Search ..... 264/103, 136, 137, 210 F; 57/140 BY, 250, 295, 908; 28/220, 271

[56] References Cited

U.S. PATENT DOCUMENTS

| | | | |
|---|---|---|---|
| 3,423,809 | 1/1969 | Schmitt | 264/103 |
| 3,468,996 | 9/1969 | Reese | 264/103 |
| 3,705,225 | 12/1972 | Taylor | 264/103 |
| 3,790,655 | 2/1974 | Cramton | 264/103 |

*Primary Examiner*—Jay H. Woo

[57] ABSTRACT

The disclosure relates to cospinning and drawing polyester filaments to produce a composite yarn which develops bulk due to differential shrinkage of the filaments when heated. Filaments of ethylene terephthalate synthetic linear condensation polymer are melt spun to form two separate filament bundles, a water-based spring finish is applied to the filaments of one bundle and a substantially non-volatile spin finish is applied to filaments of the other filament bundle, the filament bundles are drawn under identical treatment conditions during passage along separate paths and the filaments are then combined and intermingled during passage around draw rolls. The product is a mixed-shrinkage yarn wherein the filaments treated with aqueous-based finish have a higher heat-shrinkage than the filaments treated with non-volatile finish, even though both are otherwise processed in the same manner.

8 Claims, 3 Drawing Figures

PROCESS FOR PRODUCING A MIXED-SHRINKAGE HEAT-BULKABLE POLYESTER YARN

BACKGROUND OF THE INVENTION

This invention relates to a process for spinning and drawing continuous polyester filaments, and is more particularly concerned with production of mixed-shrinkage yarn which develops bulk due to differential shrinkage of the filaments when heated.

Yarns composed of filaments which have different heat-shrinkage characteristics are well known. When these composite yarns are heated to cause shrinkage, the filaments that shrink the most cause the lesser-shrinking filaments to take a non-linear configuration that imparts bulk to the yarn. Generally speaking, the greater the differential filament shrinkage, the greater will be the bulk of the yarn. One method of producing such yarns has been to combine two filament bundles which differ in that one bundle has been preshrunk to have less residual shrinkage than the other bundle. Conventional equipment for preparing uniform-shrinkage textile yarn can be operated to prepare two filament bundles which have different boil-off shrinkages. The different bundles can then be combined in an entirely separate operation, but the separate operation is an additional expense and it is difficult to intermingle the different filaments sufficiently to provide uniform bulk in fabrics made from the yarn.

Maerov et al. U.S. Pat. No. 3,199,281 discloses cospinning two bundles of polyester filaments, separately drawing the bundles, heat-relaxing one bundle to have a lower residual shrinkage than the other, and then combining the bundles with an interlacing jet to form a composite yarn in one continuous process. Since the two bundles must be traveling at the same speed when they are combined, compensation for shrinkage of filaments in the heat-relaxing step is provided by spinning the bundles at different speeds and/or drawing the bundles at different draw ratios. The patent also suggests the use of a "superstretching" at 130° to 180° C. to increase the filament length without imparting the orientation characteristic of conventionally drawn filaments. Schmitt U.S. Pat. No. 3,423,809 discloses a process in which two filament bundles are spun and drawn under identical conditions, one bundle is then annealed during passage through a steam jet device under sufficient tension to prevent shrinkage, and the bundles are then combined with an interlacing jet to form a composite yarn. The annealing treatment can provide an effective shrinkage differential between the filament bundles without having to adjust for the shrinkage which occurs in the heat-relaxing treatment mentioned previously. However, this process requires equipment for the annealing step which is not used in conventional production of continuous filament yarn.

SUMMARY OF THE INVENTION

The present invention provides for continuous production of mixed-shrinkage, heat-bulkable polyester yarn by a process suitable for use at spinning positions conventionally used for producing yarn of uniform-shrinkage filaments, e.g., additional heat-relaxing or annealing equipment is not required. Two filament bundles can be spun from the same polymer, drawn to the same draw ratio at the same speed and combined into a composite yarn to form a mixed-shrinkage yarn in a continuous process. The filament bundles can be combined at the draw rolls to facilitate intermingling of the different filaments.

The process of this invention for producing mixed-shrinkage, heat-bulkable yarn is an improvement over previously-known methods. The process is suitable for use on machines conventionally used in the production of continuous-filament textile yarn by a continuous process wherein polyester filaments are melt-spun from spinneret orifices, quenched, converged into a filament bundle and drawn with draw rolls to at least the natural draw ratio. The improved process of the present invention comprises melt-spinning filaments of ethylene terephthalate synthetic linear condensation polymer to form two filament bundles, applying a water-based spin finish to one filament bundle and applying a spin finish to the other filament bundle which contains less than 10 percent water and is substantially non-volatile at temperatures up to at least 130° C., drawing the separate bundles under indentical treatment conditions during passage through a zone of dry heat, and then combining the drawn filament bundles before or on the draw rolls to intermingle the filaments and provide a mixed-shrinkage yarn.

Preferably the filaments are spun from different orifices of the same spinneret to form the two filament bundles at a single spinning position. However, adjacent spinnerets of a spinning machine can be used to form the two filament bundles.

The filaments are drawn to at least the natural draw ratio, since less complete drawing results in undrawn segments which cause uneven dyeing and harsh tactility in fabric. A conventional draw ratio of about 2× to 5× may be employed (the natural draw ratio decreases with increasing spinning speeds). The two filament bundles are drawn to the same draw ratio at the same speed and under the same conditions except for the difference in finishes. Examples 1 and 2 illustrate drawing in jets of dry steam, which are usually supplied with steam from a common source at 30 to 150 pounds per square inch gage pressure (2.1 to 10.5 kg/cm$^2$) and 170° to 375° C., but any known means for providing dry heat is acceptable.

The filaments of the two bundles are spun from ethylene terephthalate synthetic linear condensation polymer which may be polyethylene terephthalate homopolymer or may be a copolymer wherein at least 95 mole percent of the repeating structural units are ethylene terephthalate and the remainder are units which do not appreciably affect behavior of the filaments in the drawing step. For example, about 2 mole percent of 5-(alkali metal sulfo)isophthalate units are frequently used to impart improved dyeability to the product. The filaments are conveniently spun from molten polyester supplied from the same source. However, polyethylene terephthalate homopolymer can be used for one bundle of filaments and ethylene terephthalate copolymer with 5-(alkali metal sulfo)isophthalate can be used for the other bundle of filaments to form yarn which is suitable for providing heather effects in dyed fabrics.

Because the filaments of the two bundles are drawn at the same bundle speeds to the same draw ratio, good filament intermingling is obtained when the bundles are combined on the draw rolls. The intermingled filaments may be interlaced after the draw rolls by passage through an interlacing jet, which provides a cohesive yarn bundle.

It is highly surprising that application of different types of spin finishes to the filaments of the two bundles, followed by drawing under identical treatment conditions, can produce a mixed shrinkage yarn. The water-based spin finish may comprise an aqueous emulsion of about 2 to 10 weight percent filament lubricants. The other spin finish may comprise a solution or dispersion of filament lubricants in an organic liquid which is substantially non-volatile at temperatures up to at least 130° C. and, more preferably, up to at least 160° C. During drawing of the filaments, the water-based spin finish apparently restricts the temperature of these filaments to about 100° C. or less, because of the heat taken up in vaporizing water, so that only slight crystallization of the polyester takes place; a relatively high shrinkage is obtained when such filaments are subsequently heat-relaxed to cause crystallization. On the other hand, when the filaments having the substantially non-volatile spin finish are drawn, temperature rise due to the heat of drawing increases the temperature of these filaments to greater than about 130° C. Crystallization develops rapidly and these drawn filaments have relatively high crystallinity and low shrinkage. The two types of filaments can then be intermingled to provide a mixed shrinkage yarn.

DETAILED DESCRIPTION

Figure 1:
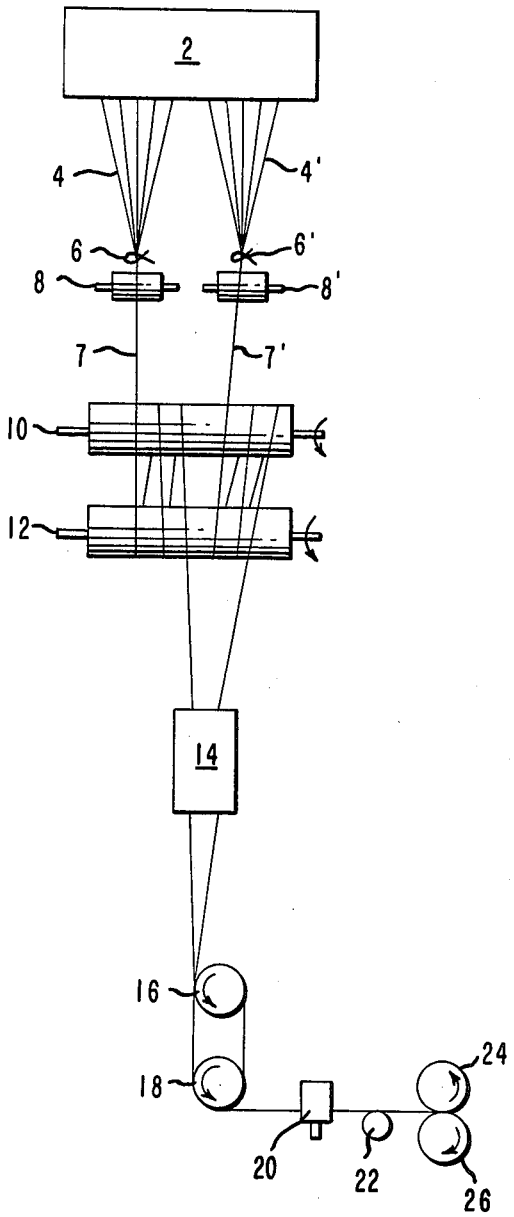
FIG. 1 is a schematic representation of one embodiment of the process and apparatus for use in the process.

Referring to FIG. 1, the filaments are spun from melt-spinning assembly 2 to form two groups of filaments 4 and 4'. The two groups are separately converged at guides 6 and 6' to form filament bundles 7 and 7'. A water-based spin finish is applied by finish roll 8 to the filaments of bundle 7. A substantially non-volatile spin finish is applied by finish roll 8' to the filaments of bundle 7'. The substantially non-volatile spin finish should contain less than 10 percent by weight of water (preferably less than 5 percent water). The two bundles then pass around feed rolls 10 and 12, through separate passageways of heating device 14, and are combined into a single yarn before or on draw rolls 16 and 18. The filament bundles are kept separate until after drawing but travel at the same speed and are drawn to the same draw ratio. The feed rolls are shown schematically as a single set of rolls to emphasize that the two bundles travel at the same speed. However, two sets of feed rolls having the same surface speed may be used in operation of the process. Good intermingling of the filaments can be obtained by combining the drawn bundles before the draw rolls or as they pass onto and around the draw rolls 16 and 18. The resulting composite yarn is preferably passed through a conventional interlace jet device 20 to interlace the yarn sufficiently to form a good package at windup. A conventional antistatic lubricating composition may be applied to the yarn by finish roll 22. The yarn is then led to a windup where it is wound on package 24 which is surface-driven by drive roll 26.

Figure 2:
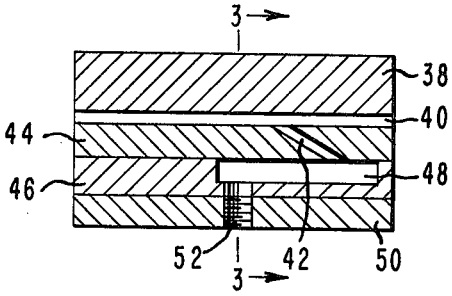
FIG. 2 is a sectional view of a draw jet device for use in the process, the cross section being taken through the axis of a steam passageway and along the axis of a yarn passageway as indicated by line 2—2 in FIG. 3.
Figure 3:
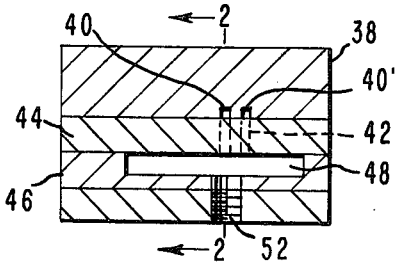
FIG. 3 is a section view of the draw jet device taken along line 3—3 of FIG. 2.

The heating device 14 provides dry heat in the draw zone. FIGS. 2 and 3 show a draw jet device. For convenience in manufacture, the device comprises four plates which are bolted together in use. Top plate 38 is grooved on the lower surface to provide yarn passageways 40 and 40'. Two passageways are shown in FIG. 3, but any number can be provided, depending upon the number of filament bundles to be treated. Each yarn passageway is intercepted by a steam passageway 42. The steam passageway are drilled at an angle through a second plate 44 so as to intercept the axis of the yarn passageway at a 30° angle as shown in FIG. 2. A third plate 46 is hollowed out to provide a common steam chamber 48 for supplying steam to the passageways under uniform conditions. A bottom plate 50 completes the assembly. The opening 52, which is suitably threaded for attaching a steam-supply pipe, conducts steam into the chamber 48. Steam supplied at 30 to 150 pounds per square inch gage pressure (2.1 to 10.5 $kg/cm^2$) and 170° to 375° C. is normally used.

Filament bundle 7 is passed through yarn passageway 40 and filament bundle 7' is passed through yarn passageway 40'. The drawn filament bundles are then combined in overlapping relationship on draw rolls 16 and 18 so that the filaments are intermingled during passage around the rolls to form a composite yarn. The draw rolls can be heated to heat-set the yarn, or the yarn can be heat-set subsequently. Heat-setting temperatures within the range of 90° to 120° C. are used with a time of heating which is of sufficiently short duration to provide the desired mixed-shrinkage properties. If the heat-setting treatment is severe there may not be sufficient difference between the residual shrinkage of the two types of filaments.

Spin finishes are conventionally used to protect filaments during drawing. A wide variety of compositions have been used for this purpose. Suitable compositions are disclosed in Gray U.S. Pat. No. 3,701,248, and in Piazza and Reese U.S. Pat. No. 3,772,872. Such compositions are applied to give from 0.1 to 2 weight percent of dry finish on yarn (foy), preferably about 0.2 to 1 weight percent foy. A finish can be applied as an aqueous solution or emulsion or as a solution or dispersion in an organic liquid. In accordance with the present invention, the water-based spin finish applied to one filament bundle may comprise an aqueous emulsion of about 2 to 10 weight percent filament lubricants; when applied in the usual manner the water provides sufficient cooling to effectively retard crystallization of the ethylene terephthalate polymer during drawing of the filaments. In accordance with this invention, the substantially non-volatile spin finish applied to the other filament bundle may comprise a solution or dispersion of filament lubricants in an organic liquid which is substantially non-volatile at temperatures up to at least 130° C. and, more preferably, up to at least 160° C.; when applied in the usual manner it does not appreciably retard crystallization of the polymer during drawing of the filaments.

The water-based spin finish used in Examples 1 and 2 is a 2 weight percent aqueous emulsion of a composition containing 49 parts by weight of isocetyl stearate, 24.5 parts of sodium di-(2-ethylhexyl)sulfosuccinate, 24.5 parts of the condensation product of 1 mole of stearyl alcohol with 3 moles of ethylene oxide, 1 part of triethanolamine and 1 part of oleic acid. Good results are also obtained when using a 10 percent aqueous emulsion instead of a 2 percent aqueous emulsion.

EXAMPLE 1

Polyethylene terephthalate of about 22 relative viscosity (HRV) is spun into filaments from a 34-hole spinneret at a spinning temperature of 297° C. The filaments are quenched in 21° C. air, divided into two groups of 17 filaments each, and converged to form two filament bundles. One bundle is passed over a finish roll which applies a 2 percent aqueous emulsion of filament lubricants and the other bundle is passed over a finish roll which applies a substantially non-volatile spin finish. The two bundles then pass around feed rolls at 1776 yards per minute (1620 meters/minute), through separate passageways of a draw jet device supplied with steam at 50 psig. (3.5 kg./cm$^2$) and 180° C., and are combined on unheated draw rolls at 3830 yards per minute (3500 meters/minute) to give a 70 denier, 34 filament, 34 filament, mixed-shrinkage yarn. The yarn has a tenacity of 4.5 gpd and an elongation of 25.6%. The low shrinkage filaments have a boil-off shrinkage of 8.1% and the high shrinkage filaments have a boil-off shrinkage of 15.9% (prior to heat-setting).

EXAMPLE 2

The following examples illustrate the effect on boil-off shrinkage (BOS) and 160° C. dry heat shrinkage (160 DHS) of heat-setting the filaments at different temperatures on the draw roll.

Polyethylene terephthalate of 23.4 relative viscosity (HRV) is spun into filaments at a spinning temperature of 297° C. and quenched in 21° C. air. The quenched filaments pass over a spin finish roll, pass around feed rolls at 667 yards per minute (610 meters/min.), pass through a draw jet device supplied with 180° C. steam at 50 psig (3.5 kg/cm$^2$) and pass around enclosed draw rolls at 2550 yards per minute (2332 meters/min) to give a draw ratio of 3.83. The temperature of the draw rolls is varied from room temperature (about 25° C.) to 140° C., as indicated in the table below. A substantially non-volatile spin finish is used for the low shrinkage filaments and a 2 percent aqueous emulsion of spin finish is used for the high shrinkage filaments.

| Draw Roll | Low Shrinkage Filaments | | High Shrinkage Filaments | |
|---|---|---|---|---|
| Temp. °C. | BOS (%) | 160 DHS(%) | BOX(%) | 160 DHS(%) |
| ~25° | 11.2 | 14.9 | 19.3 | 21.1 |
| 90 | 11.7 | 14.2 | 16.4 | 19.4 |
| 110 | 9.5 | 13.4 | 10.2 | 14.8 |
| 120 | 8.9 | 13.1 | 9.2 | 14.2 |
| 130 | 7.5 | 12.3 | 7.7 | 13.1 |
| 140 | 6.2 | 11.4 | 5.4 | 12.0 |

The data shows that shrinkage of the high shrinkage filaments decreases more rapidly than that of the low shrinkage filaments as the draw roll temperature is increased. The bulk obtained from the yarn of this example is undesirably small when heat set at the higher temperatures. The shrinkage differential (boil-off shrinkage of the higher shrinking filaments minus the dry heat shrinkage of the lower shrinking filaments) controls bulk development. If heat treatment of the yarn prior to finishing in the fabric reduces or eliminates this shrinkage differential, desirable bulk is not developed.

When the filaments are spun at speeds greater than 3000 yards per minute (2740 meters/minute), measured at feed rolls 10 and 12, the filaments are spin-oriented and only a small amount of draw is required to produce commercial drawn yarn. This drawing can be accomplished on a draw-texturing machine as disclosed in Piazza and Reese U.S. Pat. No. 3,772,872 dated November 20, 1973. In accordance with a modification of the process described previously, ethylene terephthalate synthetic linear condensation polymer is melt-spun to form two filament bundles, a water-based spin finish is applied to one filament bundle and a substantially non-volatile spin finish is applied to the other filament bundle, and the filament bundles are combined before or on draw rolls at a speed of at least 3000 yards per minute (2740 meters/minute) to intermingle the filaments and provide a mixed-shrinkage feed yarn for draw-texturing. For this process, the apparatus shown in FIG. 1 is modified by omitting heating device 14, and replacing feed rolls 8 and 10 with means for guiding the two filament bundles together onto draw rolls 16 and 18, which then serve to pull the filaments away from melt-spinning assembly 2 to provide spin-orientation.

As disclosed in U.S. Pat. No. 3,772,872, a yarn produced at a speed of at least 3000 yards per minute (2740 meters/minute) is characterized by an elongation at break of less than 180 percent and a birefringence of at least 0.025. The yarn produced as described above is further characterized by filaments of higher heat-shrinkage (the filaments treated with a water-based spin finish) and filaments of lower heat-shrinkage (the filaments treated with a substantially non-volatile spin finish). When the yarn is draw-textured, differential shrinkage of the filaments at the first heater of the machine places the higher shrinkage filaments under greater tension than the lower shrinkage filaments, resulting in a core containing higher shrinkage filaments and a surface layer of lower shrinkage filaments. If the spin finish used on the lower shrinkage filaments provides an interfilament boundary coefficient of friction (fs 70° C.) which is lower than that of the higher shrinkage filaments, the lower shrinkage filaments will be preferentially squeezed out of the core. The examples of U.S. Pat. No. 3,772,872 give values of fs 70° obtained with various spin finishes.

EXAMPLE 3

A mixed-shrinkage feed yarn for draw-texturing is prepared by melt-spinning polyethylene terephthalate homopolymer of 22 relative viscosity containing 0.3 percent $TiO_2$. Spinnerets at adjacent spinning positions are used to form two filament bundles of 34 filaments. Each of the 34 capillaries in each spinneret is 15 mils in diameter and 60 mils long (0.38×1.52 mm). The filaments are quenched and finish is applied. The two filament bundles, each with a different finish, are then combined, passed around take-up rolls at a speed of 3500 yards per minute (3200 m/minute) and wound up at a speed of 3458 yards per minute (3160 m/minute) as a 250 denier, 68 filament yarn.

In the above process, one filament bundle is treated with the water-based spin finish of the previous examples, but containing 3.9 weight percent of the non-aqueous finish components. It is applied to provide about 0.5 percent finish on yarn. Filaments treated with this finish have an fs 70° C. value of at least 0.40. The other filament bundle is treated to have between 0.7 and 1.25 percent finish on yarn of tetraethylene glycol di-2-ethylhexoate (Flexol® 4GO) represented by the formula,

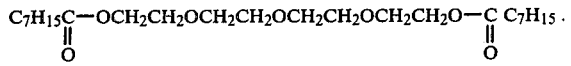

Filaments treated with this finish have an fs 70° C. value of at most 0.36.

The combined yarn is draw-textured on an ARCT-440 machine, using a spindle speed of 389,600 rpm., a twist of 66 turns per inch (2600 turns/meter), a first heater temperature of 220° C., a 12 percent overfeed at the second heater and a take-up underdrive to give acceptable package formation. When a draw-texturing draw ratio is provided which gives a prespindle tension of 28±2 grams, there is preferential breakage of the filaments treated with water-based spin finish during production of the yarn. The broken filaments are partially entrapped within the yarn bundle, do no extend very far beyond the textured yarn surface, and are restrained within the bundle by unbroken filaments. The textured yarn is knit into a tubing on a Lawson FAK knitting machine. The resulting fabric is scoured and dyed with "Latyl" Blue FLW. The dyed fabric is evaluated subjectively by a panel of raters and found to have desirable aesthetics similar to those of a fabric prepared from spun yarn. Random tumble pill testing showed the fabric to have an acceptable rating of about 4.0 after 60 and 90 minutes.

Comparison Example

Example 3 is repeated except that a water-based spin finish is used which gives an fs 70° C. value of less than 0.37, and the draw-texturing draw ratio is increased to give a similar number of broken filament ends. Examination of the textured yarn showed long free ends extending several inches from the yarn surface. Finished and/or dyed Lawson knit tubing prepared from the yarn is found to be unacceptable, with long fuzzy or hairy ends of objectionable appearance by the panel of raters. In random tumble pill testing, the fabric reaches a completely unacceptable rating of less than 2.5 in less than 30 minutes and remains unacceptably pilled after 60 and 90 minutes.

Test Methods

Relative viscosity (HRV) is the ratio of the viscosity of a solution of 0.8 gram of polymer dissolved at room temperature in 10 ml of hexafluoroisopropanol containing 100 ppm $H_2SO_4$ to the viscosity of the $H_2SO_4$-containing hexafluoroisopropanol itself, both measured at 25° C. in a capillary viscosimeter and expressed in the same units.

Boil-off shrinkage (BOS) and dry heat shrinkage at 160° C. (160 DHS) are determined as follows:

The yarn to be tested is wound on a reel the number of times required to provide a loop denier of 3,000, using the formula $n=1500/D$ wherein n is the number of turns and D is the denier of the yarn. The loop denier increases 2D for each turn. A reel 1.125 meters in circumference is commonly used for these shrinkage tests. The loop is removed from the reel, a 26.4 gram weight is suspended therefrom, and its length ($L_O$) is measured. The weight is removed and the loop is then suspended in boiling water at 100° C. for 1 hour. The loop is then removed from the boiling water, the weight is again suspended therefrom, and its length ($L_B$) is measured. $BOS(\%)=100\ (L_O-L_B)/L_O$.

For dry heat shrinkage a loop is prepared in the same manner, a 26.4 gram weight is suspended from the loop, and its length ($L_O$) is measured. The weight is removed and the loop is suspended in an oven at 160° C. dry heat for 30 seconds. The loop is then removed from the oven and allowed to cool. The weight is again suspended from the loop and its length ($L_H$) is measured. 160 $DHS(\%)=100\ (L_O-L_H)/L_H$.

Tests for tenacity, break elongation, interfilament boundary coefficient of friction (fs 70° C.) and birefringence are described in U.S. Pat. No. 3,772,872.

Random Tumble Pilling Test (RTPT) is conducted in accordance with ASTM test D 1375-72, which has been approved as an American National Standard test by the American National Standard Institute. A Random Tumble Pilling Tester available from the Atlas Electric Devices Company, Chicago, Illinois, is used for the test. The Tester uses cork-lined cylindrical chambers, 5.75 inch (146 mm) in diameter by 7.81 inch (198 mm) long, in which fabric specimens are tumbled by rotating impellers, 4.75 inch (121 mm) long and centered to provide 0.50 inch (12.7 mm) clearance between the impeller end and the chamber wall. The specimens and small amounts of short length cotton fiber are tumbled in a random rubbing motion to form pills that resemble those produced in actual wear in appearance and structure.

Three specimens 4.19 inch by 4.19 inch (105×105 mm) are cut at 45° angle to the wale from each fabric sample to be tested. The edges of the specimens are sealed by applying a strip of cement no more than one-eighth inch (3.2 mm) wide. After drying, the three specimens and about 25 mg of about 0.2 inch (5 mm) length cotton sliver are tumbled in a chamber for 30 minutes. The specimens are then removed from the chamber, excess lint is removed by vacuum, and the specimens are evaluated for the extent of pilling. The specimens and about 25 mg of cotton sliver are returned to the chamber and tumbled for an additional 30 minutes. The specimens are again freed of excess lint and evaluated for the extent of pilling after the total of 60 minutes of tumbling. The specimens are evaluated under a desk lamp for resistance to pilling, using the following scale:

5—Excellent (no pilling)
4—Good (slight pilling)
3—Medium (moderate pilling)
2—Poor (heavy pilling)
1—Very poor (severe pilling)

A set of five photographs for RTPT rating of specimens is available from ASTM Headquarters, Philadelphia, Pa.

I claim:

1. In the production of continuous-filament textile yarns by a continuous process wherein polyester filaments are melt-spun from spinneret orifices, quenched, converged into a filament bundle, and drawn with draw rolls to at least the natural draw ratio; the improvement for producing a mixed-shrinkage, heat-bulkable yarn which comprises melt-spinning filaments of ethylene terephthalate synthetic linear condensation polymer to form two filament bundles, applying a water-based spin finish to one filament bundle and applying a spin finish to the other filament bundle which contains less than 10 percent water and is substantially non-volatile at temperatures up to at least 130° C., drawing the separate bundles under identical treatment conditions during passage through a zone of dry heat, and then combining the drawn filament bundles before or on the draw rolls to intermingle the filaments and provide a mixed-shrinkage yarn.

2. A process as defined in claim 1 wherein the filaments are spun from different orifices of the same spinneret to form the two filament bundles.

3. A process as defined in claim 1 wherein the separate bundles are drawn at a draw ratio of about 2X to 5X.

4. A process as defined in claim 1 wherein the separate bundles are drawn in jets of dry steam supplied with steam from a common source at 30 to 150 pounds per square inch gage pressure and 170° to 375° C.

5. A process as defined in claim 1 wherein the intermingled filaments are interlaced after the draw rolls by passage through an interlacing jet.

6. A process as defined in claim 1 wherein the filaments are spun from molten polyethylene terephthalate supplied from the same source.

7. A process as defined in claim 1 wherein the water-based spin finish comprises an aqueous emulsion of about 2 to 10 percent filament lubricants.

8. A process as defined in claim 1 wherein the substantially non-volatile spin finish comprises a solution or dispersion of filament lubricants in an organic liquid which is substantially non-volatile at temperatures up to at least 160° C.

* * * * *